United States Patent [19]

Kennedy et al.

[11] Patent Number: 4,490,939

[45] Date of Patent: Jan. 1, 1985

[54] HARD TOP CONVERTIBLE TOY VEHICLE

[75] Inventors: Melvin R. Kennedy, New York, N.Y.; Dietmar Nagel, Chester, N.J.; Abraham A. Arad, Westport, Conn.

[73] Assignee: Buddy L Corporation. New York, N.Y.

[21] Appl. No.: 547,665

[22] Filed: Nov. 1, 1983

[51] Int. Cl.[3] ..... A63H 17/00

[52] U.S. Cl. ..... 446/448

[58] Field of Search ..... 46/201, 202, 221, 223, 46/224

[56] References Cited

U.S. PATENT DOCUMENTS

| | | | |
|---|---|---|---|
| 1,956,616 | 5/1934 | Holtom | 296/98 X |
| 1,973,220 | 9/1934 | Mohr . | |
| 2,236,143 | 3/1941 | Kellermann | 46/222 |
| 2,798,763 | 7/1957 | Dujic | 296/147 X |
| 2,841,441 | 7/1958 | Evans | 296/149 X |
| 2,860,914 | 11/1958 | Kerr | 296/149 X |
| 3,021,174 | 2/1962 | Rund | 296/107 |
| 3,227,485 | 1/1966 | Geiger | 296/147 X |
| 3,536,354 | 10/1970 | Ingram | 296/147 |
| 3,653,149 | 4/1972 | Prodger et al. | 46/201 |
| 3,748,780 | 7/1973 | Glass et al. | 46/202 |

*Primary Examiner*—F. Barry Shay

*Attorney, Agent, or Firm*—Michael Ebert

[57] ABSTRACT

A toy automobile which simulates both the appearance and performance of a modern hard top convertible. The convertible is provided with a unitary top piece which normally covers the cockpit of the car and is formed by top and side walls both joined to a rear panel. The rear panel is linked by a pair of flexible racks to a mechanism operatively coupled to the front wheel axle and adapted to swing open the top piece to expose the cockpit. In operation, when the convertible body is grasped by the player and the front is pressed down and pushed forward on a running surface, the top piece is caused to swing open, the vehicle when released by the player then continuing to travel in the forward direction. And when this same action is carried out by the player in the reverse direction, the top piece is caused to resume its normal closed position.

6 Claims, 7 Drawing Figures

HARD TOP CONVERTIBLE TOY VEHICLE

BACKGROUND OF INVENTION

Field of Invention

This invention relates generally to toy vehicles, and in particular to a toy automobile which simulates both the appearance and performance of a hard top convertible.

A convertible is the term applied to an automobile whose top may be folded back, lowered or removed to expose the car interior. A hard top convertible is an automobile similar to a conventional convertible in that it also is lacking in vertical posts between the side windows, but it differs therefrom in having a rigid top of plastic or metal that in some models is fixed and in others is either lowered into a rear deck or demountable.

When playing with a toy vehicle, what is most gratifying to the player is a toy which not only simulates the appearance of a full-scale vehicle, but one which functions or performs in a similar manner. Thus a child who is given a toy dump truck which looks like the real thing but is incapable of dumping a load, may have little more than momentary interest in this toy. It is for this reason that most toy dump trucks on the market include a mechanism making it possible to swing up the rear cradle to dump a load contained therein; for a toy of this type has far greater play appeal than a dump truck lacking this capability.

By the same token, hard top convertibles are highly popular with adults; and children who play with miniature versions thereof are not satisfied with a toy that merely looks like a convertible, for it must also perform in a like fashion. In this regard, it is to be noted that in a modern full-scale convertible, such as that disclosed in the Rund U.S. Pat. No. 3,021,174, there is no need to manually raise or lower the top, for a hydraulic mechanism is provided for this purpose. In the Rund arrangement, the hard top is supported either in a raised position over the passenger compartment or in a retracted position in back of this compartment, the transfer being effected by a power cylinder.

With a view to satisfying the play requirements for a toy convertible, the 1934 Mohr U.S. Pat. No. 1,973,220 shows a toy convertible with a hinged top. However, no mechanism is provided to operate the top.

Of greatest prior art interest is the 1973 Glass et al. U.S. Pat. No. 3,748,780 in which a toy vehicle propelled by spring motor is provided with a pivoted rear panel which, when open, exposes the driver. The mechanism for this purpose includes a pair of rigid rack strips which are linked to the rear panel and are driven by separate pinions coupled to the spring-wound motor.

An elaborate mechanism is provided in the Glass et al. patent to cause the wound motor to turn the pinions and thereby advances the racks to swing open the rear panel. When the pinions reach the smooth, tooth-free ends of the racks, they run freely thereon, and the motor is then caused by the mechanism to engage the drive wheels to propel the vehicle.

SUMMARY OF INVENTION

In view of the foregoing, the main object of this invention is to provide a toy which simulates both the appearance and performance of a modern hard top convertible.

More particularly, an object of this invention is to provide a toy hard top convertible which, when the player grasps the vehicle body and presses the front down while pushing the card on a running surface in the forward direction, this action causes the top piece of the vehicle to swing open to expose the cockpit; the vehicle, when then released, continuing to travel in the forward direction. The top piece is caused to resume its normal closed position when the same action is carried out by the player in the reverse direction.

Also an object of this invention is to provide a toy convertible of the above type which includes a slip clutch to prevent damage to the mechanism for raising and lowering the unitary top piece should the player fail to release the vehicle and continue to press it on the ground after the top piece has assumed its final raised or lowered position.

Yet another object of this invention is to provide a toy convertible which operates efficiently and reliably, and which may be mass produced at relatively low cost.

Briefly stated, these objects are attained in a toy automobile which simulates both the appearance and performance of a modern hard top convertible. The convertible is provided with a unitary top piece which normally covers the cockpit of the car and is formed by top and side walls both joined to a rear panel. The rear panel is linked by a pair of flexible racks to a mechanism operatively coupled to the front wheel axle and adapted to swing open the top piece to expose the cockpit. In operation, when the convertible body is grasped by the player and the front is pressed down and pushed forward on a running surface, the top piece is caused to swing open, the vehicle when released by the player then continuing to travel in the forward direction. And when this same action is carried out by the player in the reverse direction, the top piece is caused to resume its normal closed position.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
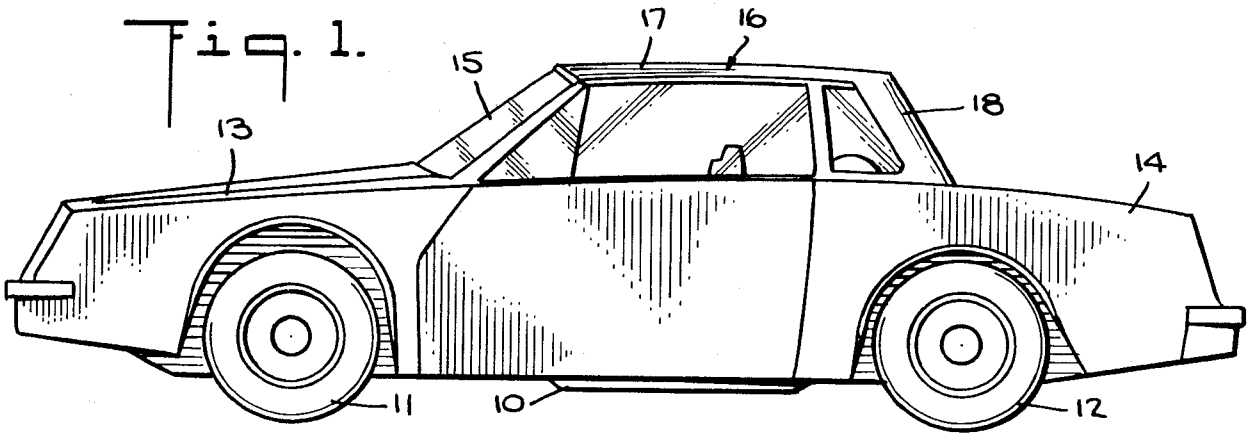
FIG. 1 is a side elevational view of a toy convertible in accordance with the invention, the top piece thereof being in its closed state.
Figure 3:
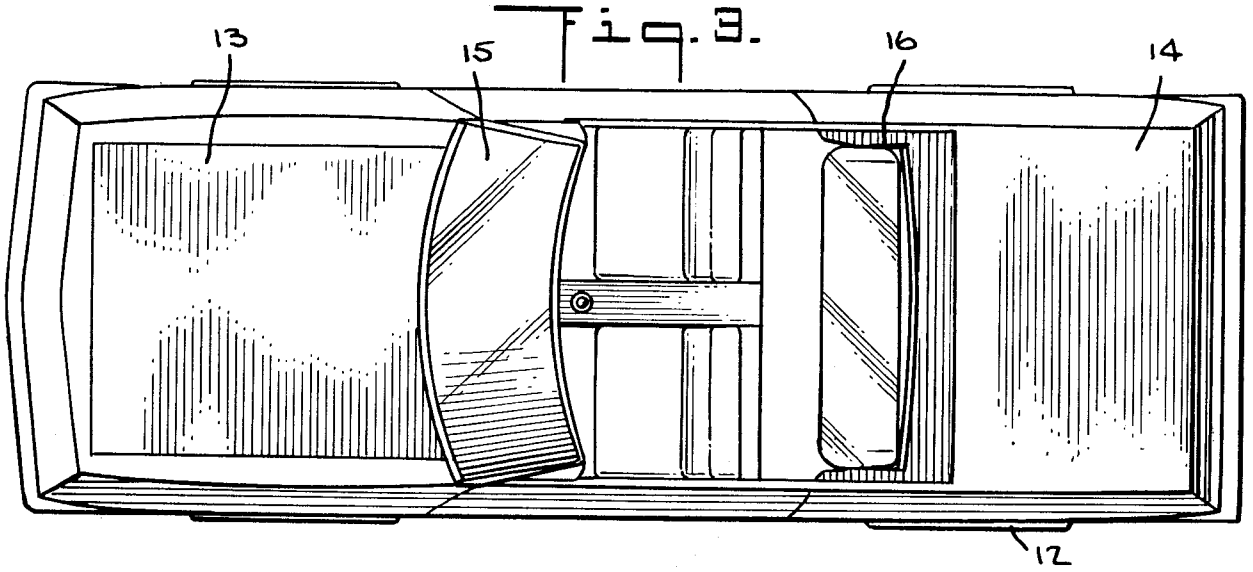
FIG. 3 is a plan view of the convertible with the top piece swung open.
Figure 2:
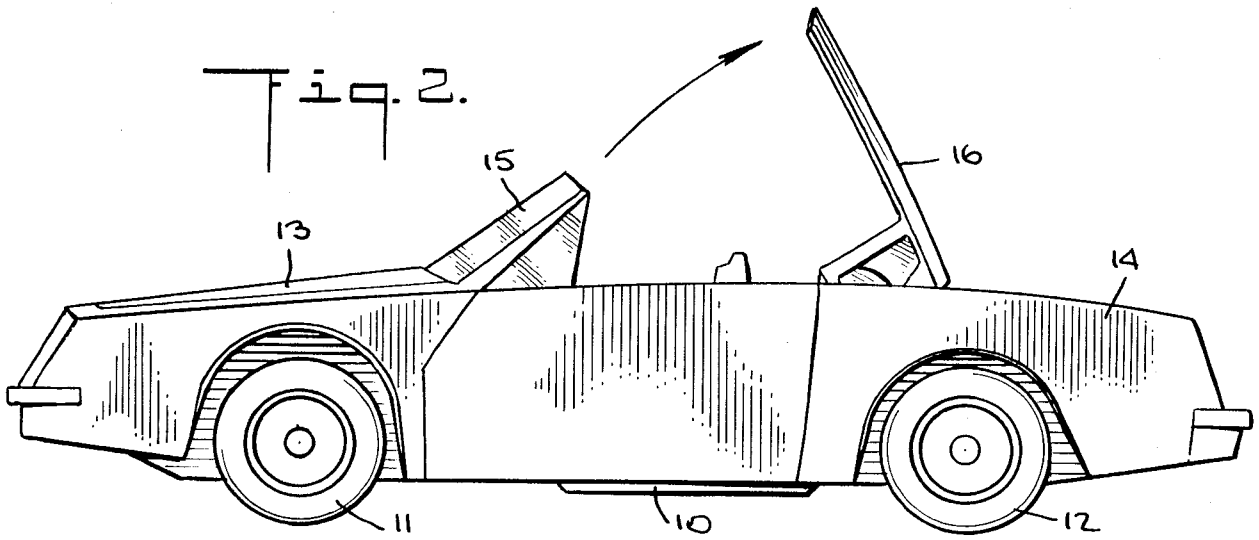
FIG. 2 shows the same convertible in side view with the top piece swung open.

Referring now to FIGS. 1, 2 and 3, there is illustrated in these figures a hard top convertible toy vehicle in accordance with the invention, the vehicle including a chassis 10 which supports a set of front wheels 11 and a set of rear wheels 12.

Mounted on chassis 10 is an automobile body that includes a motor-cowl 13, a rear trunk 14, a windshield 15 and a unitary top piece generally designated by numeral 16. As shown separately in FIG. 7, the top piece is composed of a top 17, a rear panel 18 which represents the rear window of the car, and apertured side walls 19 and 20 that simulate side windows, these side walls being integral with the top and the rear panel.

Top piece 16, in its normal position in which the front edge of top 17 abuts the upper edge of windshield 15, covers a cockpit 21 for the driver and a passenger. It is to be understood that while the drawing shows a two-door coupe, in practice, the invention can be realized in a four door sedan or in any other hard top convertible configuration.

Figure 7:
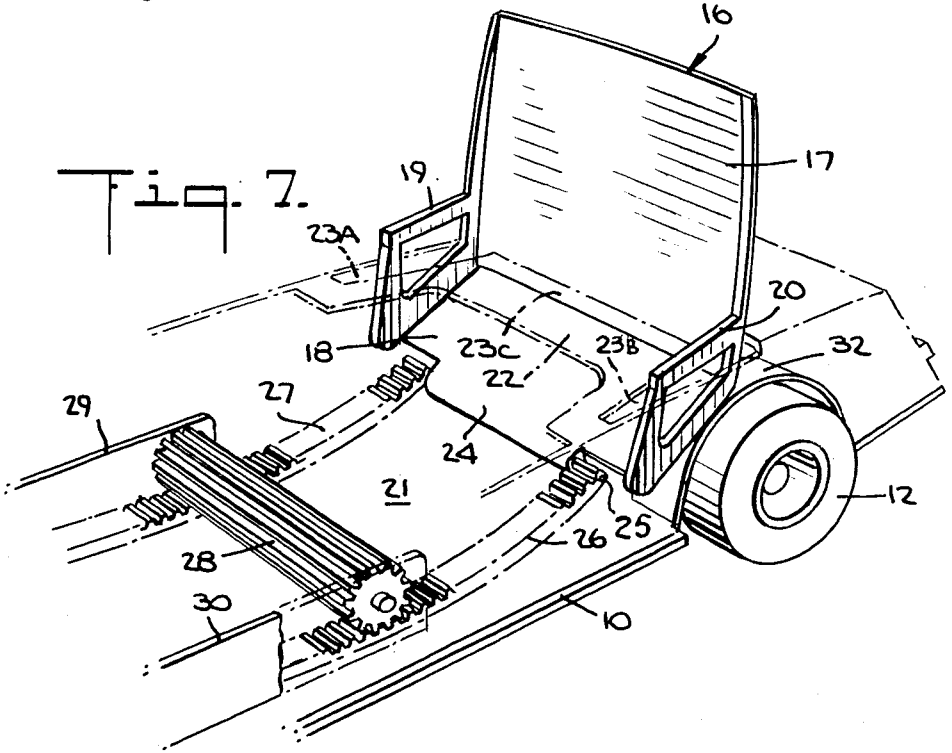
FIG. 7 is a separate perspective view of the unitary top piece and its associated flexible racks.
Figure 6:
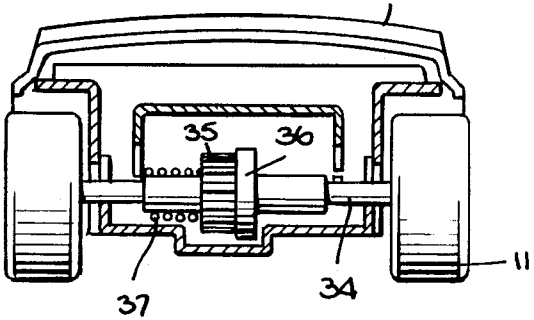
FIG. 6 is a transverse section taken through the convertible in the plane of the front wheels thereof.

As shown in FIG. 7, the upper edges of the doors of the car body are bridged by a yoke 22. This yoke is contoured to define in conjunction with the body of the vehicle a U-shaped socket within whose side slots 23A and 23B are accommodated the side walls 19 and 20 of the top piece, and within whose rear slot 23C is accommodated the rear panel 18 of the top piece.

When the top piece is swung open by the mechanism, to be hereafter described, the top thereof, as shown in FIG. 2, is almost erect to expose the cockpit 21 in the manner of a real convertible. In practice, the chassis, the body and the top piece may be molded of high strength synthetic plastic material, such as PVC or polyethylene.

As shown in FIG. 7, the lower edge of the rear panel 18 of the top piece is provided with an extension tongue 24 having a transverse bore therein to accommodate a metal pin 25 whose ends project on either side of the tongue. Attached to the pin ends are a parallel pair of flexible strips 26 and 27 which are in a toothed rack formation. These strips are fabricated of high-strength, synthetic plastic material, such as polypropylene.

These rack strips pass under a rack pinion 28 which bridges the two straps and is supported for rotation between a pair of parallel side plates 29 and 30 vertically mounted on the chassis. A cross bar which joins the side plates 29 and 30 under rack pinion 28 forms a nip for the rack strips to cause the pinion to engage the teeth of the racks.

When, therefore, rack pinion 28 is caused to rotate in the clockwise direction, this rotation forces the rack strips 26 and 27 to advance toward the front of the car and thereby pull and swing open the top piece, the corners of the side walls 19 and 20 riding on the arcuate guards 32 which overlie the rear wheels 12. When rack pinion 28 is caused to turn in the counterclockwise direction, this causes the rack strips to move toward the rear of the car to close the top piece.

Figure 4:
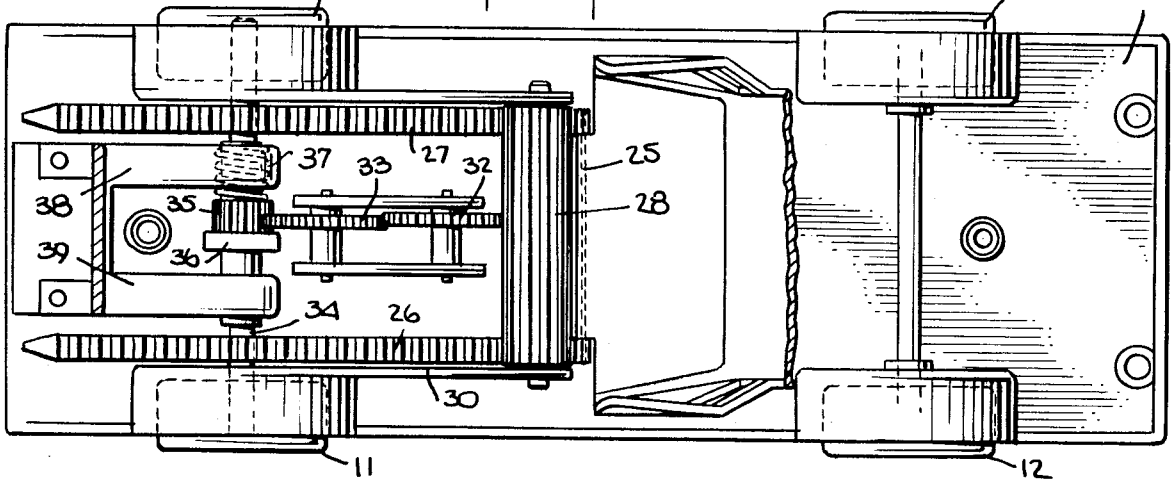
FIG. 4 is a plan view of the convertible with the body removed from the chassis to expose the mechanism for operating the top piece.
Figure 5:
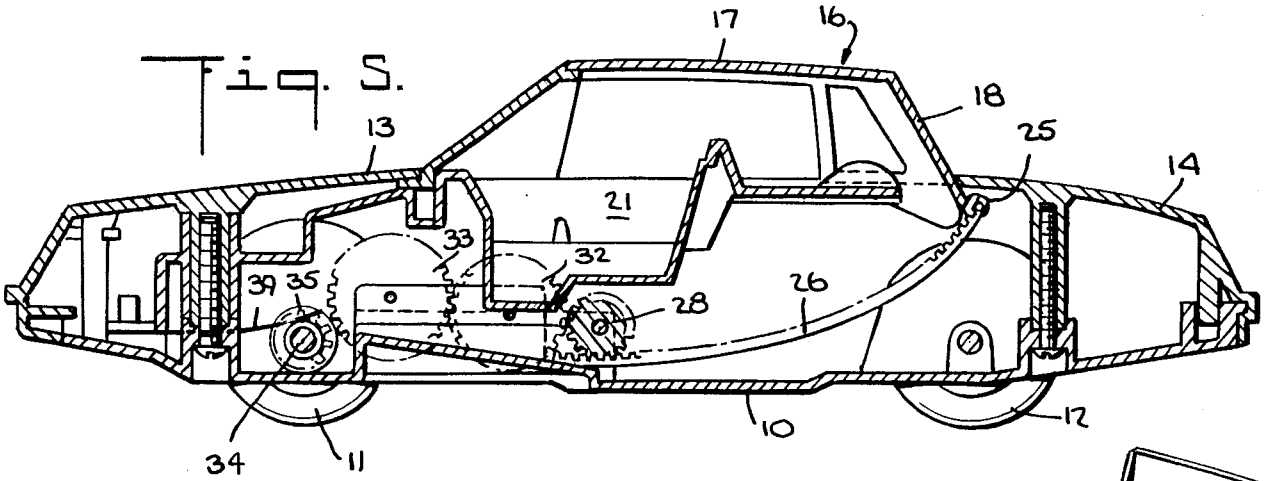
FIG. 5 is a longitudinal section taken through the convertible.

Mounted for rotation on the chasis between the rack strips 26 and 27, as shown in FIG. 4, are a pair of intermeshing spur gears 32 and 33, spur gear 32 engaging rack pinion 28. Freely mounted on axle 34 of the front wheel set 11 is a drive pinion 35, the drive pinion being pressed against a clutch plate 36 on the axle by a helical spring 37 surrounding the axle. A pair of flat springs 38 and 39 engage the opposite ends of front wheel axle 34 to provide a downward bias which acts to normally disengage the drive pinion 35 from spur gear 33.

When, however, the body of the vehicle is grasped by a player and pressed down on a running surface to overcome the downward bias, the drive pinion 35 is then brought into meshing engagement with spur gear 33; and when the player holding the car pushes it forward, the resultant rotation of front wheel axle 34 causes the drive pinion to turn, this rotation being transmitted by the spur gears 33 and 32 to rack pinion 28 which then proceeds to advance racks 26 and 27 in the forward direction, thereby raising the top piece 16.

When the top piece is fully raised, the player releases the vehicle which then moves in the forward direction for a distance depending on how hard the car is pushed by the player. If, however, the player fails to release the toy vehicle when the top piece is fully raised, at this point the racks cannot move and thereby prevent further turning of the spur gears and the drive pinion coupled thereto. The resultant drag causes the clutch plate 36 to disengage from the drive pinion, thereby preventing damage to the mechanism.

To close the top piece, the same action is repeated in the reverse direction; that is, the player again presses down on the front of the car body to cause the drive pinion to engage the spur gear. But this time, the car is pushed in the reverse direction causing the racks to advance toward the rear and to bring the top piece down to cover the cockpit. Should the player continue to press down the car after the top piece is in place, the clutch plate will disengage from the drive pinion to prevent damage to the mechanism.

While there has been shown and described a preferred embodiment of hard top convertible toy vehicle, it will be appreciated that many changes and modifications may be made therein without, however, departing from the essential spirit thereof.

We claim:

1. A toy vehicle which simulates both the appearance and performance of a hard-top convertible, said vehicle comprising:

A. a chasis supporting a set of front and rear wheels, said front wheels being fixedly mounted on a rotatably mounted axle;

B. a body supported by and above said chassis and including a fixed windshield and a hard-top piece swingable with respect to the windshield which in its normally closed position abuts said windshield, and which when swung open and fully raised exposes a cockpit within the body; and C. means mounted on said chasis operatively intercoupling said hard-top piece to said front wheel axle to cause said piece to swing open when the front of the body is grasped by a player and pressed down and the vehicle is pushed in the forward direction on a running surface to cause said axle to rotate, the vehicle when released by the player continuing to travel in the forward direction, said means causing the hard-top piece to resume its normally closed position when the same action is carried out by the player in the reverse direction.

2. A toy vehicle as set forth in claim 1, wherein said means include a drive pinion mounted on said front wheel axle and rotatable therewith, a first gear which when engaged by said drive pinion operates a rack mechanism coupled to said top piece, and a spring engaging said axle to normally maintain said drive pinion out of engagement with the gear, engagement being effected when the body is pressed down.

3. A toy vehicle as set forth in claim 2 wherein said hard-top piece is constituted by a top, a rear panel representing the rear window of the vehicle and a pair of side walls simulating side windows and integrated with the top and rear panel.

4. A toy vehicle as set forth in claim 3 wherein said rack mechanism is constituted by a parallel pair of flexible rack strips secured at one end to opposite sides of the rear panel of the hard-top piece and a rack pinion engaging said strips to cause them to advance concurrently in a direction determined by the direction of pinion rotation, said rack pinion being rotated by a second gear coupled to said first gear.

5. A toy vehicle as set forth in claim 4 wherein said strips are molded of synthetic plastic material.

6. A toy vehicle as set forth in claim 4 further including a clutch plate on the front wheel axle which cooperates with said drive pinion to disengage said drive pinion from the axle when further movement of the rack strips is arrested.

* * * * *